US005692322A

United States Patent [19]

Lombardino

[11] Patent Number: 5,692,322

[45] Date of Patent: Dec. 2, 1997

[54] COMBINATION ATHLETIC SHOES AND PLOMETRIC TRAINING DEVICE

[76] Inventor: Thomas D. Lombardino, 82-11 160th Ave., Howard Beach, N.Y. 11414

[21] Appl. No.: 727,706

[22] Filed: Oct. 3, 1996

[51] Int. Cl.[6] ..... A43B 3/24; A43B 21/40; A43B 23/10

[52] U.S. Cl. ..... 36/100; 36/36 A; 36/36 B; 36/42; 482/79

[58] Field of Search ..... 36/100, 36 R, 36/36 C, 36 A, 36 B, 42; 482/79

[56] References Cited

U.S. PATENT DOCUMENTS

| | | | |
|---|---|---|---|
| 1,888,617 | 11/1932 | Bridi | 36/42 |
| 2,466,611 | 4/1949 | Nicoletti | 36/36 R |
| 2,582,551 | 1/1952 | Malherbe | 36/42 |
| 4,214,384 | 7/1980 | Gonzalez | 36/42 |
| 5,373,649 | 12/1994 | Choi | 36/36 R X |
| 5,419,060 | 5/1995 | Choi | 36/36 R |
| 5,519,950 | 5/1996 | Wang | 36/36 R |

*Primary Examiner*—Ted Kavanaugh

[57] ABSTRACT

Combination athletic shoes and plyometric training devices are disclosed. The said shoes having removable heels that include a snap-lock track slide retainer fixedly disposed in the sole at the instep of the athletic shoe, a heel track slide retainer fixedly disposed in the sole at the heel of the athletic shoe and having a lower surface with a female portion of a dovetail joint therein, and a heel track slide with integral forward snap-lock insert fixedly attached to the heel of the athletic shoe and having a male portion of a dovetail joint on the top thereof that slidably engages the female portion of the dovetail joint in the lower surface of the heel track slide retainer and which is releasibly retained thereto by a release disposed on the bottom of the athletic shoe. This arrangement allows for the athletic shoe to function in a combination use in that without the heel in place the shoe can be used as plyometric type strength training device for the lower leg muscles. With the heel attached, this arrangement allows for a means of preventing any movement or inadvertent detachment of the heel, thus allowing the shoe to function as a regular use athletic shoe.

4 Claims, 3 Drawing Sheets

COMBINATION ATHLETIC SHOES AND PLOMETRIC TRAINING DEVICE

BACKGROUND OF THE INVENTION

1. Field of the Invention

The present invention relates generally to athletic shoes designed for basketball play, and more specifically, to athletic shoes which can be converted from general type athletic shoes into plyometric type strength building training shoes which can increase the users running speed and vertical jumping ability over a period of use. This conversion is accomplished by way of a specially designed sole and removable heel assembly on the shoes. With minor out-sole modifications, the invention is suitable as a cross-training type of shoe, or for tennis or running shoe applications.

2. Description of the Prior Art

A conventional athletic shoe heel is an integral part of the sole which is generally molded in one piece in the manufacturing process. Aside from being easier to manufacture in this manner, an athletic shoe that is to be worn during sport, especially a sport as rigorous as basketball, needs a heel that will withstand the constant forces that will be applied to it upon running and jumping.

While bearing in mind that a regular athletic shoe needs a heel that is firmly attached during use, there are shoes on platforms, as well as platform devices that strap onto shoes, that essentially serve as to transfer weight from the heel of the shoe to the forward sole of the shoe. This principal, called plyometric training, which essentially strengthens the calf muscles and achilles tendons of the lower leg due to increased extension and exertion of the muscles during exercise, is the secondary function of the shoes described herein. It is in this alternative function however, that the elimination of the heel is desirable and necessary to allow the forward sole to hold the weight of the wearer, and to achieve the clearance needed to allow for the additional heel dip movement that will also help serve to strengthen the lower leg muscles over time of continued use in this application.

It is out of these two valid functions that the development of this invention was initiated. It serves the function of a general use athletic shoe when the removably attached heel unit is interlocked within the sole of the shoe via a snap-locking track slide retainer fixedly disposed at the instep area of the sole that prevents any horizontal movement of the unit. A second heel track slide retainer fixedly disposed in the sole at the heel area of the shoe will prevent any vertical movement of the unit. When the entire unit is interlocked in place, it also serves to prevent any lateral movement of the heel, and, also important during rigorous athletic activity, it will prevent any torque of the heel or the sole of the shoe. These several components of attachment when used collectively will provide for a synergy that effectively will allow the shoe to function in a normal manner, giving the user the required support that is needed from a regular type athletic shoe.

When the shoes are to be used in their training form, the heel is detached from the shoe by way of depressing a plastic snap lock insert and release that is integrally attached to the heel track slide which is fixedly attached to the detachable heel, from the snap-lock track slide retainer fixedly disposed in the sole at the heel of the athletic shoe. In this application, the shoe functions as a plyometric training shoe, with a special paddle shape design sole that provides greater stability when the heel is absent, as well as secondary heel projection that is integral to the sole in the training mode that serves to protect the components of the detachable heel from wear during its use in this application.

In referring back now to the platform type shoes, which have a U.S. Pat. No. 3,739,500 invented by Cox, and the strap on devices that are removably attached to regular shoes that provide for plyometric training principals, they do serve the same function, but it is not accomplished in the same manner. Further, the aforementioned products do not serve a combination purpose, and are only designed for training exercises, and cannot be used for general usage as the combination product I disclose herein.

In further researching of prior patents, several have been identified with interchangeable or exchangeable heels. All but one are related to men's dress type shoes or ladies high heels with a means for replacing or exchanging worn heels. Only one Patent, U.S. Pat. No. 5,373,649, issued to Choi, entitled "Sports Shoes with exchangeable heels", show athletic type shoes with a removable type heel. However, this design is also exclusively for the purpose of exchanging a worn heel that is removable only for the purpose of interchanging the heel with another heel, and its means of accomplishing the removability of the heel are also different than that of the invention disclosed herein. Also, although the innovation of the prior art may be suitable for its specific individual purpose, it is in no way suitable for the purpose which the invention disclosed herein will provide, that being a combination plyometric training device and athletic shoe. Further, its application to a viable as well as durable athletic product are questionable due to it execution of design and, I believe its reduction to pratice would incur some difficulty. In addition, it is stated within the background of the invention, and more specifically, on the final line of the description of prior art, that "the above separable heel has some problems which should be overcome". It is of my opinion that the invention I submit can be easily produced and is commercially viable based on thorough market research.

SUMMARY OF THE INVENTION

A principal object of the invention is to provide an athletic shoe that has a removable heel.

It is a further objective of the invention to provide an athletic shoe with a removable heel that will allow for the wearer to use the shoe as a means of plyometric strength training that will enable the wearer to build the calf muscles and achilles tendons of the legs, when the heel is removed from the shoe.

It is another objective to provide for an athletic shoe that will perform like, and be as durable and comfortable as any other high quality conventional athletic shoe in regular use when its removable heel is secured in place.

It is still another objective that with the removable heel in place, the unique interlocking assembly will provide for preventing any relative movement of the heel and inadvertent detachment of the heel during normal use of the shoe.

It is yet another objective that it perform just as well and be as equally durable in the training mode with the heel removed.

It is still a further objective to have an athletic shoe that converts from the training configuration to the conventional configuration and back again without having to dismount the shoe and with the release of only a single locking mechanism.

It is a final objective of the invention to be relatively easy as well as cost effective to manufacture, based on the technologies of shoe manufacturing that are currently in use.

These and other objects of the invention are realized by providing a shoe that comprises a heel that attaches and detaches to the heel section of an athletic shoe. The heel contains a male portion of a dovetail track slide with integrally attached snap-lock insert that is fixedly disposed into the heel by way of parallel insert stabilizing tabs. The heel section of the sole of the shoe will contain a female portion of a dovetail track that is fixedly disposed into the heel section of the sole also by way of parallel insert stabilizing tabs.

To further lock the heel securely in place in accordance with the embodiment of the invention, the snap lock insert that is integrally attached to the male portion of the dovetail track as noted in the preceding paragraph is inserted horizontally into the snap-lock track slide retainer that is fixedly disposed into the sole at the instep of the athletic shoe by way of insert stabilizing tabs. This lock-in effect is accomplished by the pliability of the downward protruding catch lever extending down from the snap-lock insert that slides up upon insertion into the snap-lock track slide retainer, and than snaps down into locking position once fully engaged into the snap-lock track slide retainer. Reversing the process by pushing the catch lever up from through a cutout on the bottom of the sole in the area of the snap lock track slide retainer will release the heel unit and allow its removal by sliding it out horizontally from the female portion of the dovetail track slide.

DETAILED DESCRIPTION OF THE PREFERRED EMBODIMENTS

Figure 1:
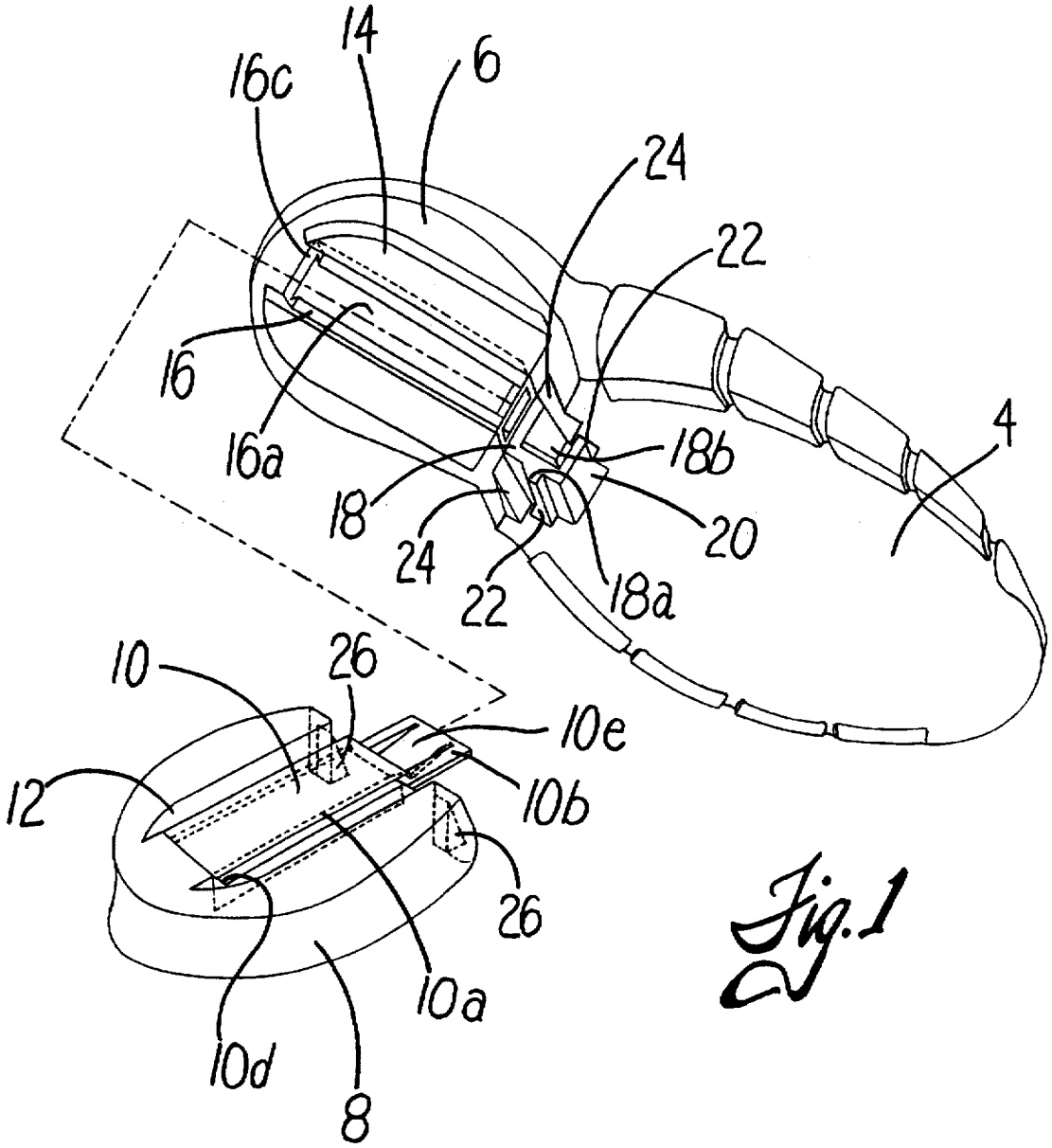
FIG. 1 is an exploded bottom perspective view of an athletic shoe with a removable heel for allowing the shoe to be used as a training device according to a preferred embodiment of the invention.

With reference to FIG. 1 there is shown the sole 4 of an athletic shoe and a removably attachable heel 8 that are correspondingly configured to allow an interlocking engagement between the components to allow the heel structure to perform as if it were integral to the athletic shoe.

The said sole 4 will include an integral molded vertical snap-lock retainer channel 20 within the area of the instep, which further include integrally molded vertical snap-lock stabilizing retainer channels 22. These channels 20, 22 are provided to secure the snap-lock track slide retainer 18 that is inserted up through and fixedly disposed in the instep area of the sole. The heel section of the sole 6 will be recessedly non-planar to the sole 4. It will contain an external U-shaped projection 14 with a center groove running through it that will house the fixedly disposed heel track slide retainer 16.

The said heel track slide retainer 16 will incorporate a female portion of dove tail track joint 16*a*, track slide retainer insert stabilizers 16*b* (SHOWN IN FIG. 2–5 ONLY), and an inwardly converging track stop mating section 16*c*.

The removable heel 8 will contain a heel track slide with snap-lock insert 10, which is designed to inter-lock with the heel track slide retainer 16 which is fixedly disposed within the heel section of the sole 6. The heel 8 will also contain an internally formed U-shaped recess 12 that will correspondingly engage with the externally formed U-shaped projection 14 on the heel section of the sole 6.

Another means of engagement and securing of the heel 8 is by way of parallel outwardly diverging heel insert wedges 26 the will substantially mate with parallel inwardly converging recessed heel insert wedges 24 molded within the instep area of the sole.

Engagement between the said heel track slide retainer 16 of the heel section of the sole 6 and the heel track slide with snap-lock insert 10 is accomplished when the male portion of dovetail track joint 10*a* is horizontally affixed across the female portion of dovetail track joint 16*a*. This union will be partially complete when the inwardly converging track stop mating section 16*c* of the track slide retainer 16 mates with the outwardly diverging track stop 10*d* on the heel track slide 10.

The final element of this particular interlocking mechanism will be completed when the snap-lock insert 10*b* that is integrally attached to the heel track slide 10 is inserted within the snap-lock track slide retainer 18, and the pliable catch lever 10*e* of the snap-lock insert 10*b* will move upward and then engage downward within the snap-lock retainer catch and release cutout 18*b*. Disengagement of the removably attached heel 8 cannot be achieved unless the user pushes the pliable catch lever 10*e* up back through the snap-lock retainer catch and release cutout 18*b* that is accessible through the integrally molded vertical snap-lock retainer channel 20 within the sole instep.

A final reference to FIG. 1 shows that the snap-lock track slide retainer 18 is fixedly disposed within the integrally molded vertical snap-lock retainer channel 20 within the instep portion of the sole. It is further positioned and stabilized from any type of horizontal movements by the integrally molded vertical snap-lock stabilizing retainer channels 22 also incorporated into the instep portion of the heel. These stabilizing retainer channels 22 correspond with snap-lock retainer insert stabilizers 18*a* that are integrally attached to the snap-lock track slide retainer 18.

Figure 2:
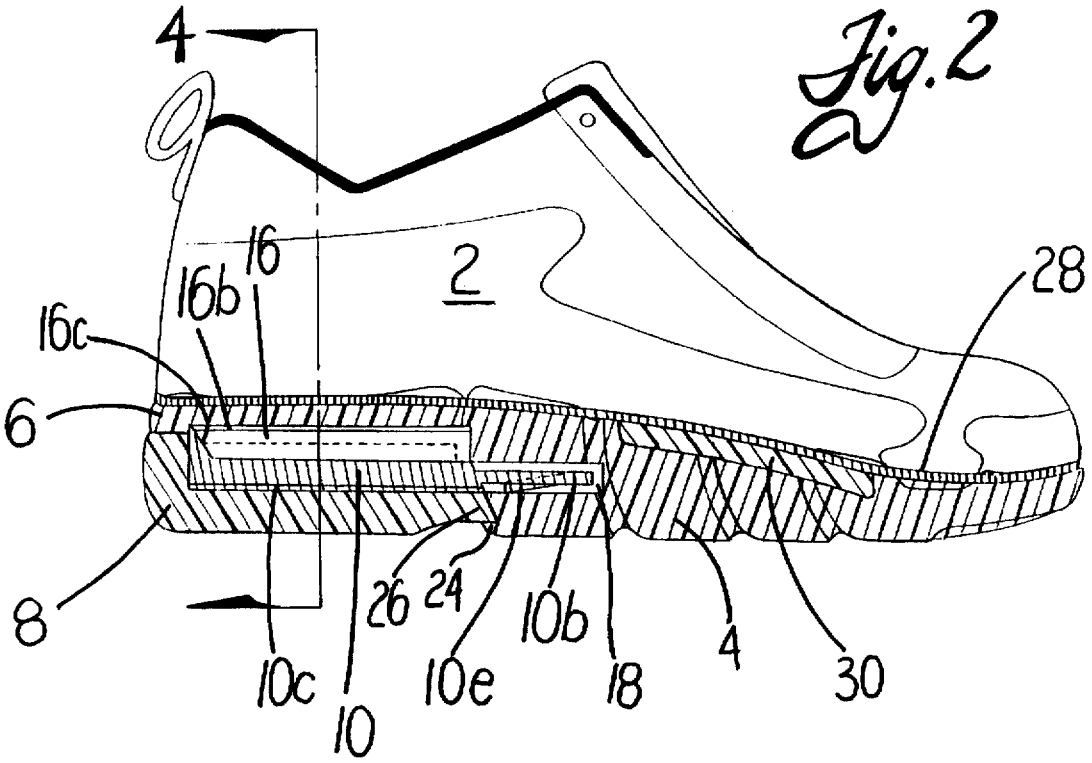
FIG. 2 is a longitudinal cross sectional view of the sole taken along line A of FIG. 4 showing the removable heel attached to the sole of the shoe, incorporating the interlocking and shock absorption qualities of the shoe.

FIG. 2 shows a longitudinal cross section of the sole 4, heel section of the sole 6 and the removably attached heel 8 of the athletic shoe 2. When completely interlocked, the heel track slide 10 with snap-lock insert 10*b* as previously described will be slidably engaged with the heel track slide retainer 16 which is fixedly disposed within the heel section of the sole 6. The snap-lock insert 10*b* portion of the heel track slide 10 is also shown inserted within the snap-lock track slide retainer 18.

More specifically, the pliable catch lever 10*e* of the snap-lock insert 10*b* is securely engaged within the snap-lock retainer catch and release cutout 18*b*. Whereas the pliable catch lever 10*e* will prevent the removably attached heel 8 from pulling back away from the sole 6, the outwardly diverging track stop 10*d* of the heel track slide 10 will prevent any further forward movement of the heel 8 when slidably engaged with the inwardly converging track stop mating section 16*c* of the heel track slide retainer 16.

Also shown in FIG. 2 is the outwardly diverging heel insert wedge 26 which is integrally molded within the front portion of the removably attached heel 8 that engages within the inwardly converging recessed heel insert wedges 24 within the instep portion of the sole.

The sole of the athletic shoe 2 will consist of a heel section 6 and a singular out-sole section 4, with no mid-sole section as most athletic shoes have. This is because the sole has to be stable enough to retain the components of the removable heel 8, and also to provide the support necessary since the shoe 4 is designed to be used without the heel section 8. The said sole will be made of a hard type of rubber such as ebonite, or a type of unfoamed polyurethane such as is commonly used in the construction of out-soles and not the sponge rubber or foamed polyurethane generally used for mid-sole construction.

To compensate for the hardness of the shoe sole 4, the area at the ball of the foot will contain an integrally molded cutout that will include a softer, shock absorbing type of insole cushioning compound 30, such as foam or sponge rubber. Above this will be a conventional type of insole lining 28.

The body or upper of the athletic shoe 2 will have all of the conventional elements of today's athletic shoes. It will also be substantially made of conventional materials and assembled with conventional construction techniques.

Figure 3:
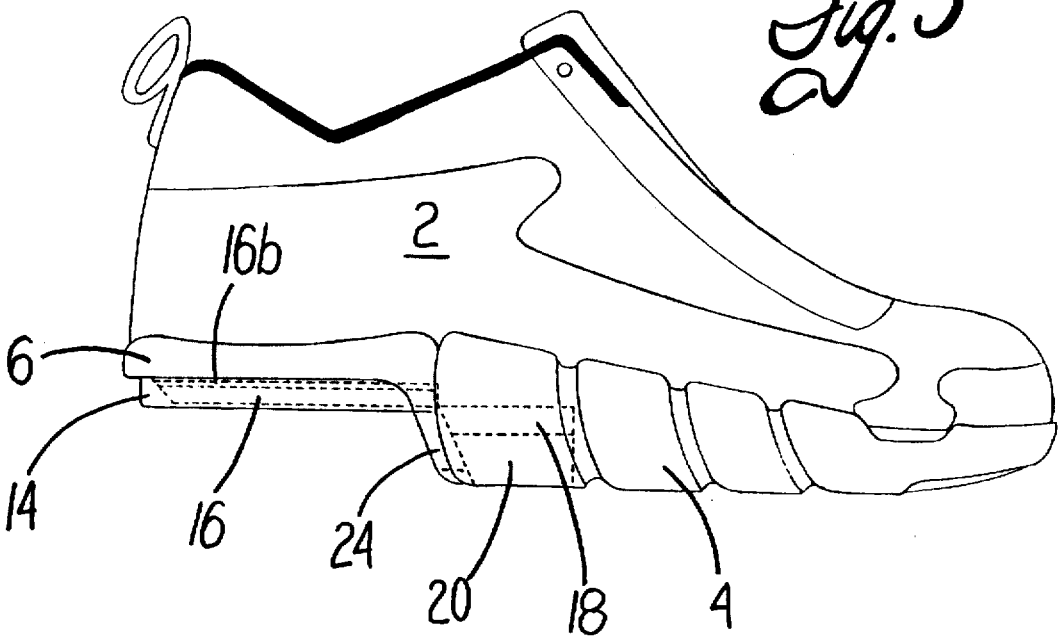
FIG. 3 is a longitudinal side view of the shoe in its training configuration with the heel removed, with phantom lines showing the fixedly attached parts within the sole of the shoe.

Referring now to FIG. 3 the athletic shoe 2 is shown in its training configuration with the heel 8 removed. There will be a minimum of 1" clearance from the bottom of the external U-shaped heel projection 14 to the planar line of the ground. This is necessary to provide for the heel of the wearer to be suspended off of the ground thereby causing the calf muscles to support 100% of the athletes body weight, thereby providing the plyometric exercising characteristics of the shoe.

The heel track slide retainer 16 is demonstrated in this drawing figure by phantom lines as it will be fixedly disposed within the center groove of the external U-shaped heel projection 14 integrally molded to the heel section of the sole 6. It will be slightly recessed below the planar line of the bottom of the U-shaped heel projection 14 to prevent any wear to the said heel track slide retainer 16 due to any contact with the ground surface during active use, The placement of the snap-lock track slide retainer 18 is shown as it is located within the integrally molded vertical snap-lock retainer channel 20 at the instep area of the sole 4.

Figure 4:
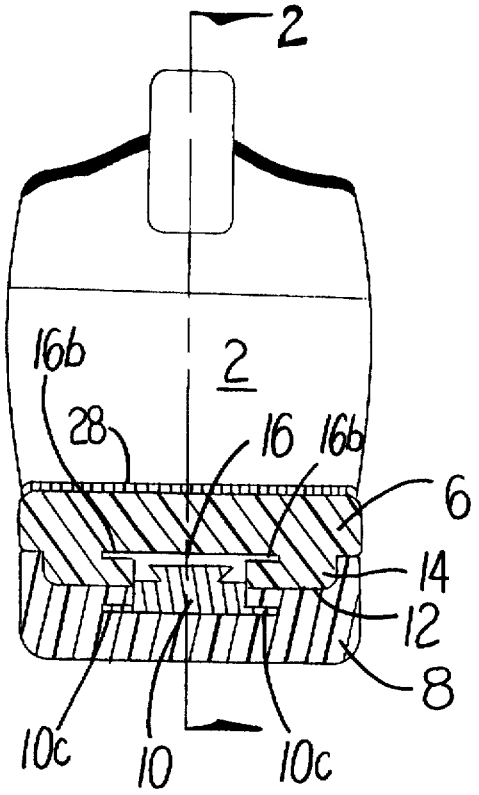
FIG. 4 is a transverse cross section view of the sole taken on line A of FIG. 2.

In FIG. 4 there is shown the rear of the athletic shoe 2. The sole 4 section is cutaway to demonstrate the corresponding union between the external U-shaped heel projection 14 which is integrally molded to the heel section of the sole 6 and the internal U-shaped recess 12 molded within the removably attached heel 8. This union allows for greater stability of the shoe 2 when used with the removable heel 8 in place.

Further demonstrated is the means for fastening the heel track slide retainer 16 within the heel section of the sole 6. This is accomplished by the track slide retainer insert stabilizers **16*b* that are integrally attached parallel to, and on opposing sides of one another, on the heel track slide retainer 16. The insert stabilizers 16*b* will slidably engage within corresponding channels molded within the heel section of the sole 6**.

The heel track slide 10 within the removably attached heel 8 is retained in position by way of the track slide insert stabilizers **10*c* that are integrally attached parallel to, and on opposing sides of one another, on the heel track slide 10. These insert stabilizers 10*c* will slidably engage within corresponding channels molded within the removably attached heel 8. These insert stabilizers 10*c*, 16*b* will prevent any vertical disengagement of the heel track slide 10 and heel track slide retainer 16**. To prevent them from slidably disengaging horizontally from their perspective placements, an adhesive such as cyanoacrylate can be used to form a more permanent bond.

When the male portion of the dovetail track joint **10*a* is slidably engaged with the female portion of dovetail track joint 16*a*, and the pliable catch lever 10*e* of the snap-lock insert 10*b* as illustrated in FIG. 2 is inserted within the snap-lock track slide retainer 18 and engaged with the snap-lock retainer catch and release cutout 18*b* also of FIG. 2, there is achieved a completely interlocking means of preventing any vertical, horizontal, lateral or torque movement of the removably attached heel 8**.

Figure 5:
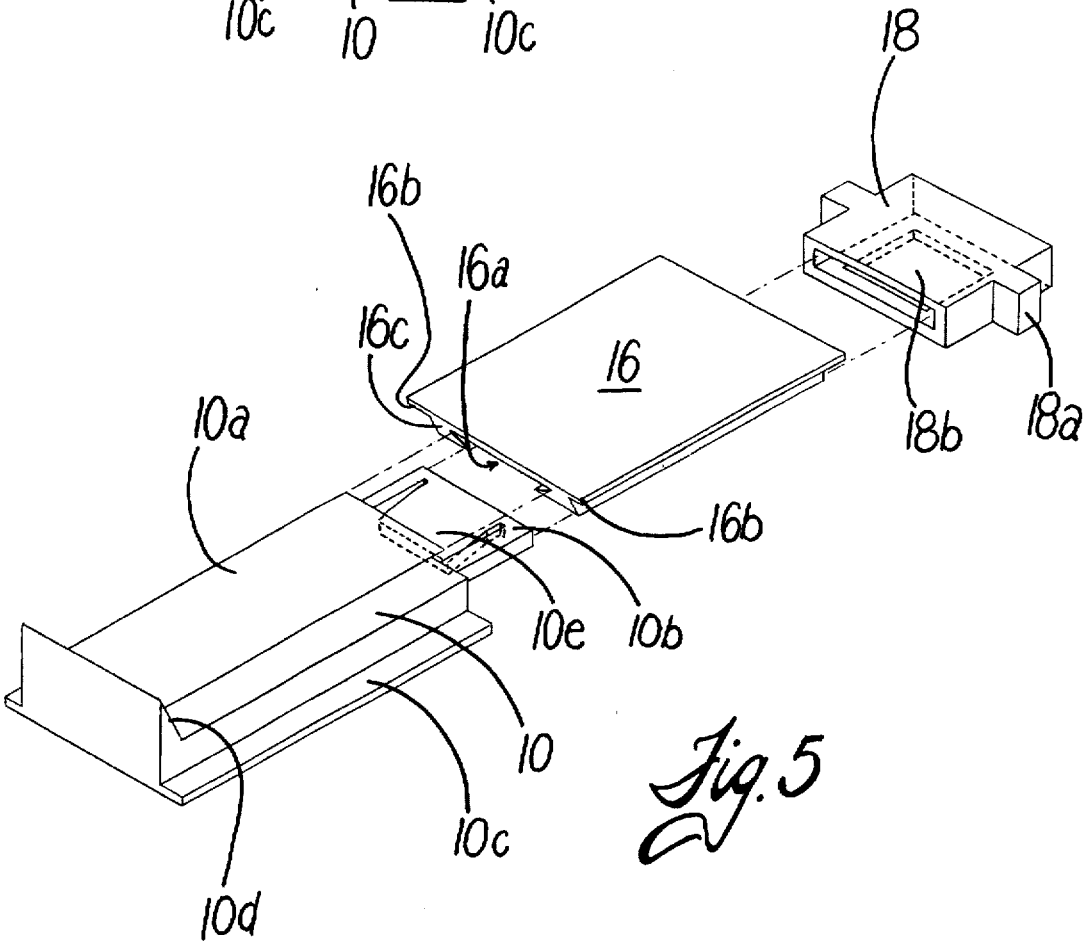
FIG. 5 is an exploded perspective view showing the interlocking mechanisms that are to be fixedly attached to the sole and heel sections of the shoe.

Finally, in FIG. 5 is shown an exploded perspective view showing the previously described interlocking elements of the current invention. Specifically, the Heel track slide 10 with snap-lock insert **10*b* which will slidably engage with the heel track slide retainer 16 and the snap-lock track slide retainer 18** as previously described in the other drawing figures. These elements can be manufactured of a molded PVC type plastic or any other similar durable material that may be suitable for this application.

Although the preferred embodiment of combination athletic shoes and plyometric training devices has been disclosed, it should be understood that various modifications in size, composition, configuration and arrangement of parts can be made by those skilled in the art within the spirit and scope of the accompanying claims.

What is claimed is:

1. Combination athletic shoes and plyometric training devices comprising:

a. an upper;

b. a rigid one piece molded sole portion which includes a heel section and an out-sole section, being fixedly attached to the upper;

c. a heel which is removably attached to the heel section of the sole of an athletic shoe by way of a plurality of interlocking fasteners that provide for a synergistic securing means of retaining the removably attached heel in place, and;

d. one such interlocking fastener being a snap-lock track slide retainer that is fixedly disposed in the sole of the shoe at the instep;

e. said retainer is held in position by way of integral parallel projections extending vertically on either side of retainer, and is positioned up through a cutout that has corresponding parallel notches running vertically up through the bottom instep portion of the sole, and;

f. the retainer will engage with a first heel track slide that comprises an integral snap-lock insert at the front, a male portion of a dovetail joint on the upper surface, a track stop at the rear, and parallel projections extending horizontally on either side at the bottom surface; and, g. said parallel projections of the heel track slide will fixedly attach the heel track slide to the removable heel by way of corresponding parallel notches running horizontally within the said removable heel component, and, h. an upper heel track slide retainer that will slidably engage with the first heel track slide by way of a female portion of a dovetail joint at the bottom surface of said heel track slide retainer, with said heel track slide retainer being fixedly disposed in the heel section of the sole of the athletic shoe by way of parallel projections extending horizontally on either side of an upper surface of the heel track slide retainer, i. the said parallel projections of the heel track slide will fixedly attach the heel track slide retainer by way of corresponding parallel notches running horizontally within the said heel section of the sole of the athletic shoe; and, j. a track stop angled inward at the bottom of the female portion of the dovetail joint which corresponds with the angle on the heel track slide of the male portion of the dovetail joint to provide for a means of preventing any horizontal movements of the attached heel when fully engaged.

2. Combination athletic shoes and plyometric training devices as defined in claim 1 wherein the heel unit is releasibly retained within the snap-lock track slide retainer by a integrally attached release disposed on the bottom of the athletic shoe.

3. Combination athletic shoes and plyometric training devices defined in claim 1 wherein:

a. the sole and integral heel section of the sole will be a one piece molded hard rubber material selected from the group consisting of ebonite and un-foamed polyurethane, with a paddle shaped bottom sole platform providing for greater stability for the wearer in the plyometric training form, and;

b. the integral heel section of the sole also includes an integrally molded U-shaped projection with a center groove running through it that will recessedly incorporate the fixedly attached heel track retainer preventing wear thereto when the shoe is used with the heel section removed; and, c. the removable heel section includes a corresponding U-shaped recess that substantially mates with the said integral molded U-shaped projection of the integral heel section of the sole and will also incorporate the fixedly attached heel track slide for engagement of the removable heel section with the integral heel section of the sole; and, d. the instep portion of the sole at the area on either side of the fixedly disposed snap-lock track slide retainer will have integrally molded parallel wedge apertures; and, e. the removable heel section at the area of the fixedly disposed snap-lock insert will include corresponding integrally molded parallel wedge protrusions which insert into the said apertures to further prevent any lateral movement of the removable heel section when attached to the shoe in it's regular use configuration.

4. Combination athletic shoes and plyometric training devices of claim 3 wherein;

a. the outsole section of said sole will contain a cutout within the area whereas the ball of the foot will situate; and b. the said cutout will contain a foamed sponge rubber cushioning compound, providing the shoes with some degree of shock absorption properties.

* * * * *